US010595625B2

(12) United States Patent
Pellegrino

(10) Patent No.: US 10,595,625 B2
(45) Date of Patent: Mar. 24, 2020

(54) TILE AND GROUT CLEANING PAD

(76) Inventor: Leonard Anthony Pellegrino, San Diego, CA (US)

( * ) Notice: Subject to any disclaimer, the term of this patent is extended or adjusted under 35 U.S.C. 154(b) by 0 days.

(21) Appl. No.: 13/349,945

(22) Filed: Jan. 13, 2012

(65) Prior Publication Data

US 2013/0180068 A1 Jul. 18, 2013

(51) Int. Cl.

| | |
|---|---|
| ***A47L 13/16*** | (2006.01) |
| ***A46B 15/00*** | (2006.01) |
| ***A47L 13/12*** | (2006.01) |
| ***A46B 3/00*** | (2006.01) |
| *A46B 7/04* | (2006.01) |
| *A46B 5/00* | (2006.01) |

(52) U.S. Cl.

CPC ..... *A46B 15/00* (2013.01); *A46B 3/005* (2013.01); *A47L 13/12* (2013.01); *A47L 13/16* (2013.01); *A46B 5/0058* (2013.01); *A46B 7/04* (2013.01); *A46B 2200/3033* (2013.01)

(58) Field of Classification Search

CPC ..... A46B 5/00; A46B 5/0004; A46B 5/0016; A46B 5/0058; A46B 15/00; A46B 3/0057; A46B 7/04; A46B 11/00; A46B 11/0006; A46B 2200/304; A46B 2200/3006; A46B 2200/3093; A47L 13/12; A47L 13/16; A47L 13/20; A47L 13/24; A47L 13/254

USPC ..... 15/114, 115, 116.1, 116.2, 119.1, 119.2

See application file for complete search history.

(56) References Cited

U.S. PATENT DOCUMENTS

| | | | | |
|---|---|---|---|---|
| 5,522,110 | A * | 6/1996 | Borofsky | A47L 13/12 15/115 |
| 6,842,936 | B2 * | 1/2005 | Policicchio | A47L 13/16 15/104.94 |
| 9,044,131 | B1 * | 6/2015 | Pence | A47L 13/10 |
| 2007/0107155 | A1 * | 5/2007 | Kacher | A47L 13/16 15/209.1 |
| 2013/0067673 | A1 * | 3/2013 | Yu | A47L 13/258 15/228 |

* cited by examiner

*Primary Examiner* — Shay Karls

(74) *Attorney, Agent, or Firm* — Gary L. Eastman, Esq.; Eastman McCartney Dallmann LLP

(57) ABSTRACT

A disposable cleaning pad having a grout cleaning brush includes a bristle attachment for use with a disposable pad. The bristle attachment is molded into a rectangular base piece forming a stand-alone removable brush that can be removably attached to a disposable pad. A top rectangular piece of similar dimensions to the base is connected to the end portion of the base by way of a hinge. The ends opposite the hinge have mating clasps that allow for the brush assembly to be securely yet removably fastened to an existing cleaning pad which is then mounted in the normal manner to the cleaning system. The brush assembly enjoys a longer life than that expected from a disposable cleaning pad thus the brush assembly may be reused many times before it needs to be replaced.

13 Claims, 10 Drawing Sheets

TILE AND GROUT CLEANING PAD

FIELD OF INVENTION

The present invention relates generally to the field of apparatus for floor and tile cleaning. More particularly, though not exclusively, the present invention relates to an apparatus for simultaneously cleaning grout and tile or stone flooring surfaces, which can be converted into a device to clean the tile, stone, or other flooring surfaces.

BACKGROUND OF THE INVENTION

The use of tile and stone floors is increasing, especially in upscale homes. The need to frequently clean the grout in between the tiles and stone is a well-known problem without any current satisfactory solution that allows for the grout to be cleaned simultaneously with the tile or stone. Without a satisfactory solution, the cleaning effort usually consists of a first process to clean the grout followed by a second process to clean the tile or stone.

The grout between tile and stone flooring is known for being difficult to clean. Some areas of grout become noticeably dirty over time due to the presence of foot traffic, food and drink spills, and pets, which can result in the accumulation of unsightly dirt and buildup. If dirt and buildup is allowed to remain on the grout for an extended period of time, the grout can become dull or stained. This effect can be compounded when unsightly areas of grout are in close proximity to areas of cleaner grout. This causes the unsightly grout to stand out even more.

Typical floor cleaning routines usually include sweeping, using a damp sponge mop, or using a cleaning agent in conjunction with a sponge mop or scrub brush. Several products have been introduced into the market that aid in the cleaning of tile, stone, or wood flooring. The more common ones consist of simple brushes connected to various handle configurations, custom made systems for specific tile designs, as well as hand held devices which are generally very labor intensive to use. These hand held devices require the user to maintain a kneeling position that becomes uncomfortable in a short period of time and results in undue stress on the users back, muscles, and joints.

In light of the above, there is currently a need for a low cost, easy to use brush and pad system to simultaneously clean extensive flooring areas where grout also needs cleaning. There is also a need for a device that is able to easily convert from a grout cleaning system to a floor cleaning system.

SUMMARY OF THE INVENTION

The present invention takes advantage of currently existing floor cleaning systems, which are generally available in local grocery and hardware stores. Such systems available today are Clorox's ReadyMop system, Rubbermaid's Reveal system, and Procter & Gamble's Swiffer Sweeper. Some of these systems use a disposable pad that can be replaced when it becomes heavily soiled while others use reusable pads that need to be washed when they become soiled.

The present invention includes a brush that is formed in a disposable cleaning pad. This design allows for the user to apply the cleaning pad and brush combination of the present invention to a floor cleaning system to clean the floor grout and tile, and then remove if necessary so a regular cleaning pad can be applied to clean areas where the grout does not need brush level cleaning or other non-grout floor areas.

An alternative embodiment of the present invention consists of a bristle attachment for use with a disposable pad. The bristle attachment is molded into a rectangular base piece forming a stand-alone, removable brush that can be removably attached to a disposable pad. Specifically, a top rectangular piece of similar dimensions to the base is connected to the end portion of the base by way of a hinge. The ends opposite the hinge have mating clasps that allow for the brush assembly to be securely yet removably fastened to an existing cleaning pad, which is then mounted in the normal manner to the cleaning system. Since the brush assembly is designed for a longer life than that expected from a disposable pad, the brush assembly can be reused many times before it needs to be replaced. With this type of removable brush, it is also possible to use the removable brush with reusable cleaning pads.

A brush handle can be used to add greater functionality to the removable brush. The handle allows for the brush assembly to be connected in a manner similar to a cleaning pad. The handle contains an area that allows the brush to be attached thereby creating a handle and brush combination. This will allow for the brush assembly to be used separately from the cleaning pad system when the grout or surface area requires a more dedicated cleaning effort. The handle is designed to be mounted to the shaft of the cleaning pad system. This will allow for easy removal of the handle when it is needed, as well as providing a storage location for the removable brush when it is not in use.

The present invention is especially suited to undertake extensive grout and floor cleaning tasks. It has the capacity to allow the grout cleaning brush and pad to be used for extensive periods of time without having to rinse and clean it. It provides for the user to clean grout without having to kneel for extended periods of time. Also, it has the advantage of being able to easily convert from a grout and tile cleaner to a floor cleaner.

DETAILED DESCRIPTION OF THE INVENTION

Figure 1:
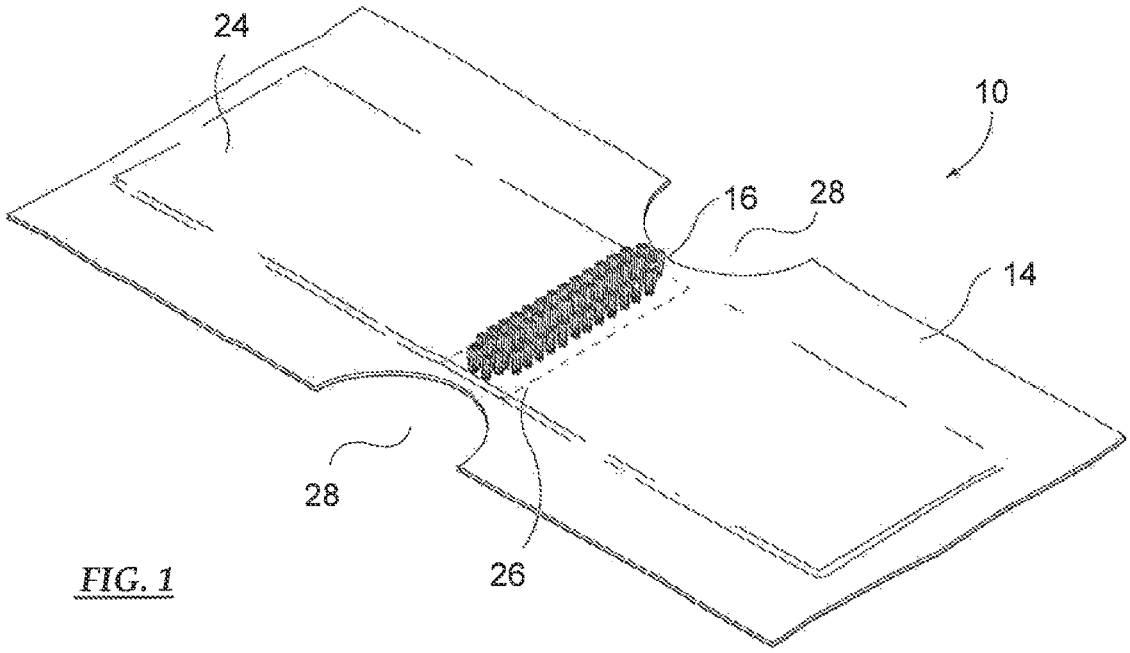
FIG. 1 illustrates a perspective view of a preferred embodiment of the present invention and shows brush bristles formed into a cleaning pad that is in turn attached to a backing sheet.

Referring initially to FIG. 1, a perspective view of the preferred embodiment of the Tile and Grout Cleaning Pad is shown and generally designated 10. The figure shows brush bristles 16 mounted into a cleaning surface 24, which in turn is connected to a backing sheet 14. The backing sheet 14 is large enough that the edges have the ability to wrap around the floor cleaning system head 21, shown in FIG. 2, far enough to be captured and held in place thus allowing the tile and grout cleaning pad 10 to remain in position during the cleaning process.

Brush bristles 16 are secured into the cleaning surface 24 by way of a brush bristle mount 26, shown in dashed lines. The brush bristles 16 are mounted transversely at the mid-point on the cleaning surface 24. By way of non-limiting example, the brush bristles 16 are secured into the cleaning surface 24 by anchoring them into a semi-rigid bristle brush mount 26 which can be made of a rubber material that is integrated into the cleaning surface 24. It is to be appreciated by anyone skilled in the art that many materials exist that can be used for the brush bristle mount 26 and this description is not intended to limit the types of materials that can be used.

The backing sheet 14 contains semi-circular cut-outs 28, one on each side and located at the mid-point of the cleaning surface 24, which allows for the Tile and Grout Cleaning Pad 10 to be mounted on any floor cleaning system 12 where components mounted to the floor cleaning head may interfere with the proper mounting and securing of the backing sheet 14.

The brush bristles 16 are of a length that will allow them to provide adequate cleaning pressure on the grout 18 while allowing the cleaning surface 24 to come into full contact with the tile 20. The brush bristles 16 are rigid enough so that they will bend when the floor cleaning system 12 is placed onto the tile 20 but will still provide enough force on the grout 18 to provide for adequate cleaning.

Figure 2:
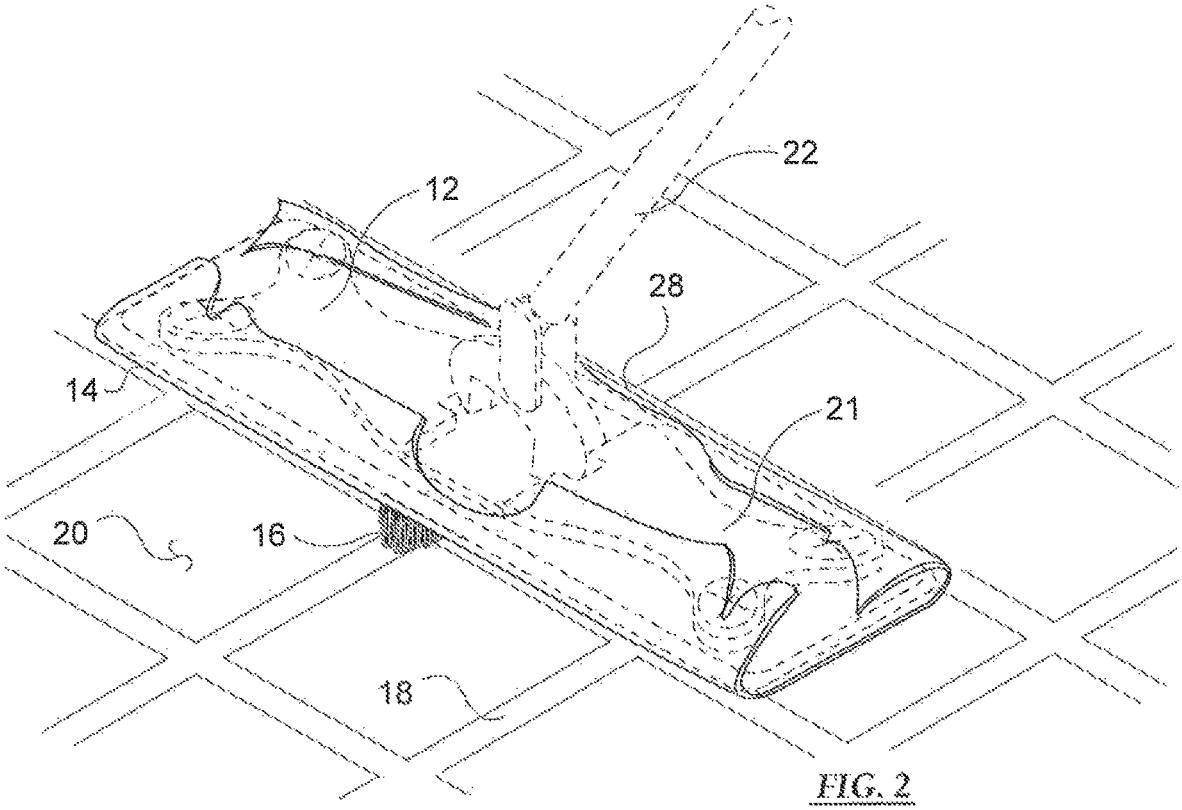
FIG. 2 is a perspective view of an implementation of a preferred embodiment of the present invention shown in FIG. 1 and shows the invention mounted to a cleaning system that demonstrates brush orientation when mounted.

Referring to FIG. 2, a perspective view of the tile and grout cleaning pad 10 mounted to a floor cleaning system 12 and being used to clean tile 20 and grout 18 is shown. It is to be noted that the brush bristles 16 are lined up with grout 18 during use, which will allow for the simultaneous cleaning of the tile 20 and grout 18.

Figure 3:
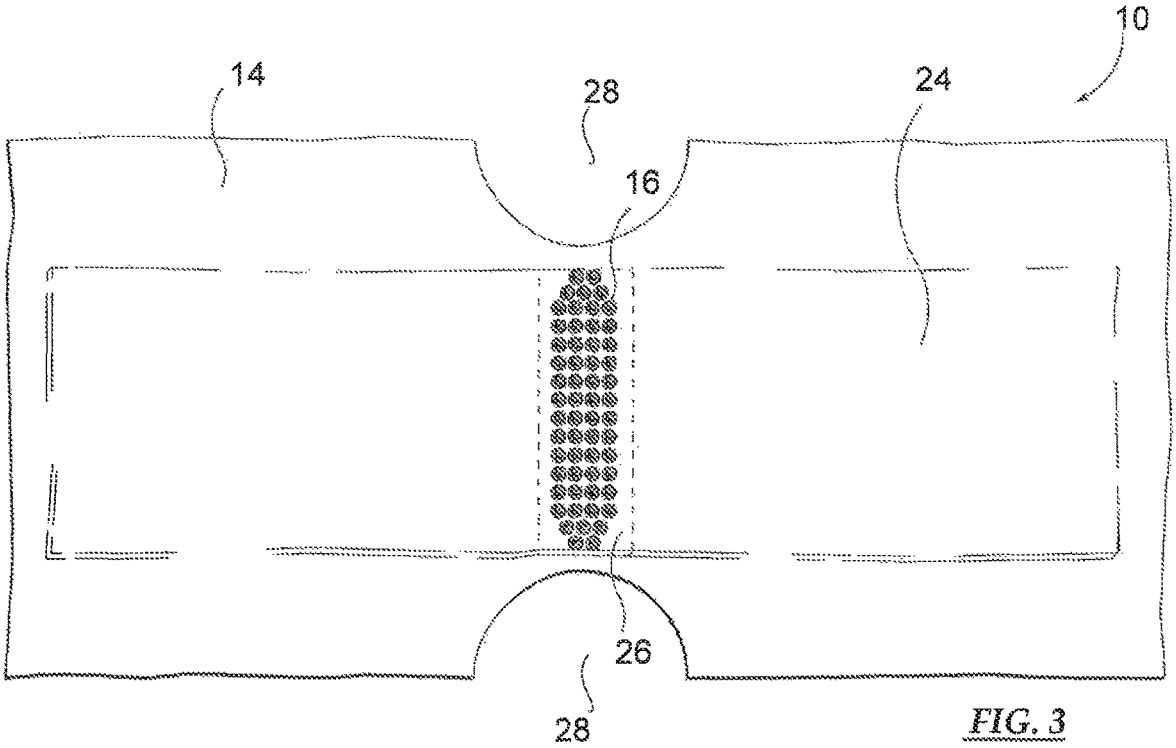
FIG. 3 shows a bottom view of the preferred embodiment of the present invention of FIGS. 1 and 2 that illustrates the relative location and size of the bristles when compared to the cleaning pad.

FIG. 3 is a bottom view of the preferred embodiment of the present invention. It demonstrates the relative placement of the brush bristles 16, the cleaning surface 24, the backing sheet 14 and the semi-circular cut-outs 28. It also shows, in phantom, the brush bristle mount 26.

Figure 4:
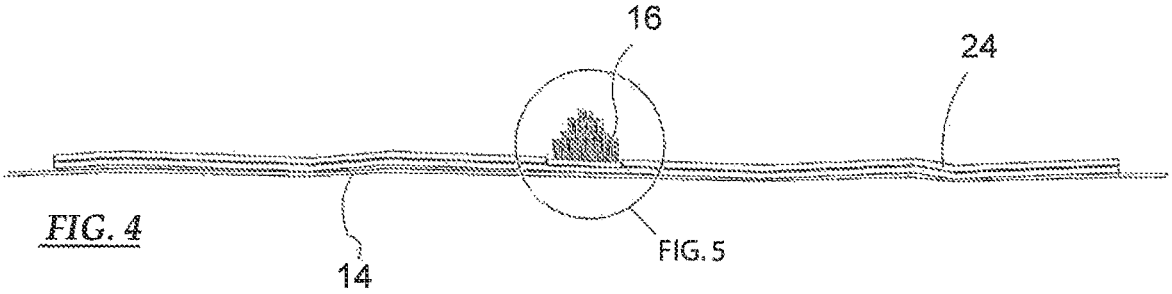
FIG. 4 is a side view of a preferred embodiment of the present invention and shows the relative size of the bristles, cleaning surface, and backing sheet.

FIG. 4 is a side view of the preferred embodiment of the present invention. It demonstrates the brush bristles 16, the cleaning surface 24, and the backing sheet 14. It also shows the location of the expanded view in FIG. 5.

Figure 5:
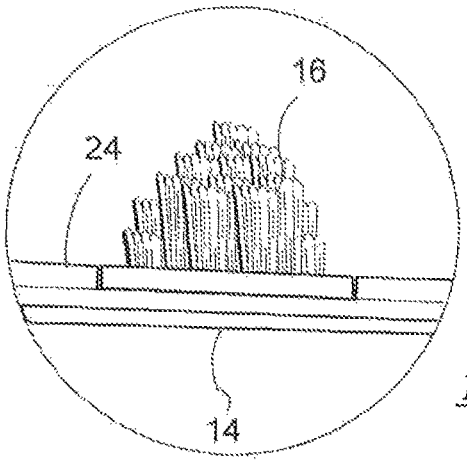
FIG. 5 is a close up view of the bristles, cleaning pad, and backing sheet as shown in FIG. 4.

FIG. 5 is an expanded side view of the brush bristles 16 integrated into the cleaning surface 24, which in turn is mounted to the backing sheet 14. It is to be noted that the distance between the top of the brush bristles 16 and the top of the cleaning surface 24 is such that they will both be in simultaneous contact with the grout 18 and the 20 respectively.

Figure 6:
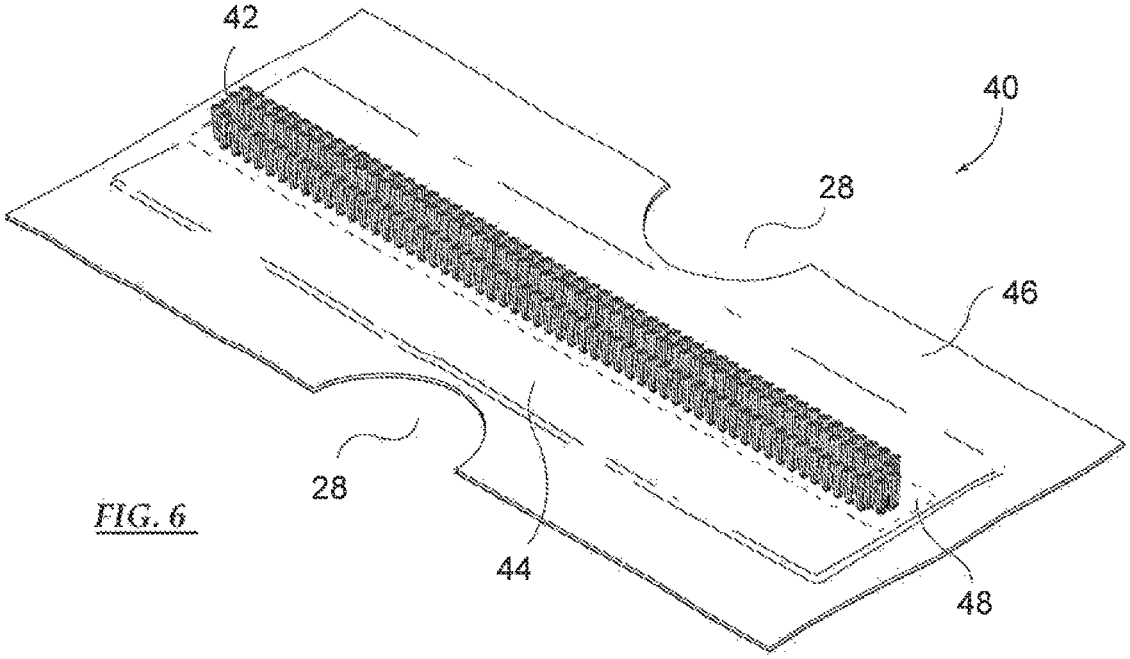
FIG. 6 is a perspective view of an alternative embodiment of the present invention, which shows grout cleaning bristles mounted longitudinally on a cleaning pad.

FIG. 6 is a perspective view of an alternative embodiment of the Tile and Grout Cleaning Pad of the present invention and generally designated 40. This figure shows brush bristles 42, brush bristle mount 48, cleaning surface 44, backing sheet 46, and semi-circular cut-outs 28. This embodiment implements brush bristles 42 mounted longitudinally along the longitudinal centerline of the cleaning surface 44. By way of non-limiting example, the brush bristles 42 are secured into the cleaning surface 44 by anchoring them into a semi-rigid bristle brush mount 48, which can be made of a rubber material, which is then integrated with the cleaning surface 44. As with other embodiments of the present invention, it is to be appreciated by anyone skilled in the art that many materials exist that can be used for the brush bristle mount 48 and this description is not intended to limit the types of materials that can be used.

Figure 7:
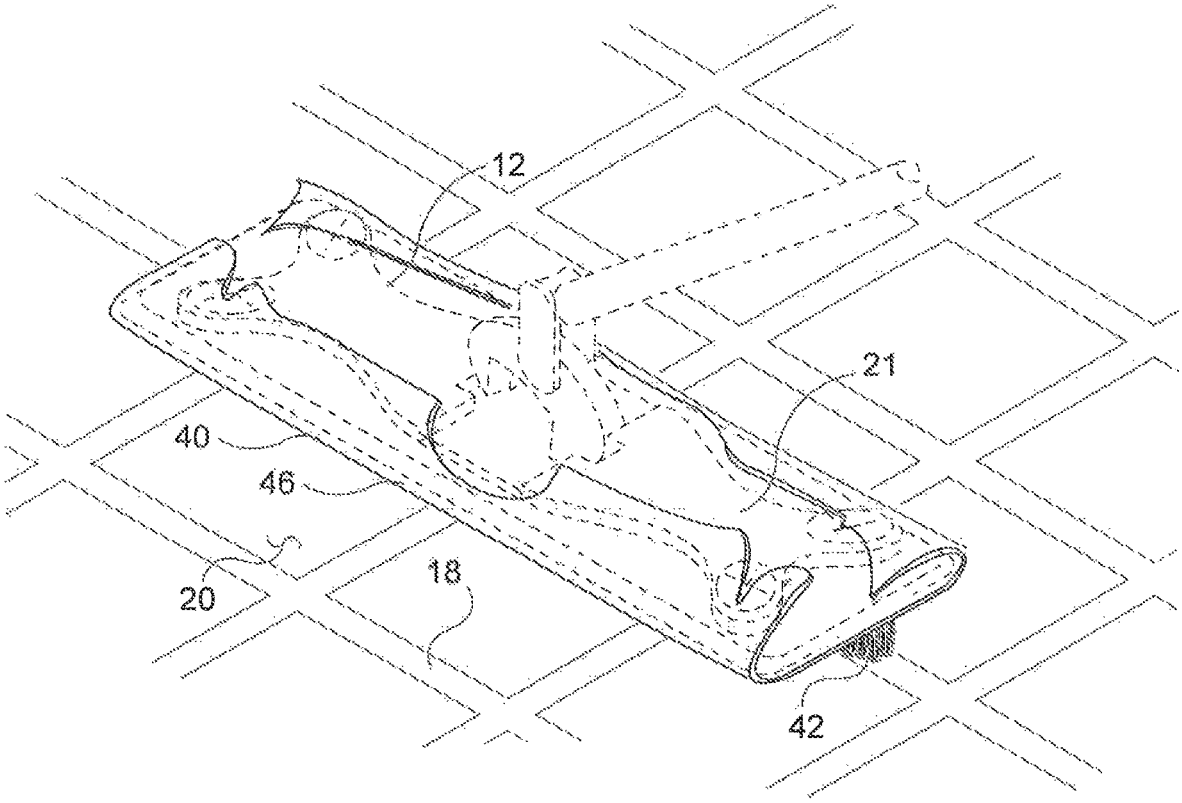
FIG. 7 is a perspective view of an alternative embodiment of the present invention shown in FIG. 6 in use.

Referring to FIG. 7, a perspective view of the tile and grout cleaning pad 40 mounted to a floor cleaning system 12 and being used to clean tile 20 and grout 18 is shown. It is to be noted that the brush bristles 42 are lined up with grout 18 during use, which will allow for the simultaneous cleaning of the tile 20 and grout 18.

Figure 8:
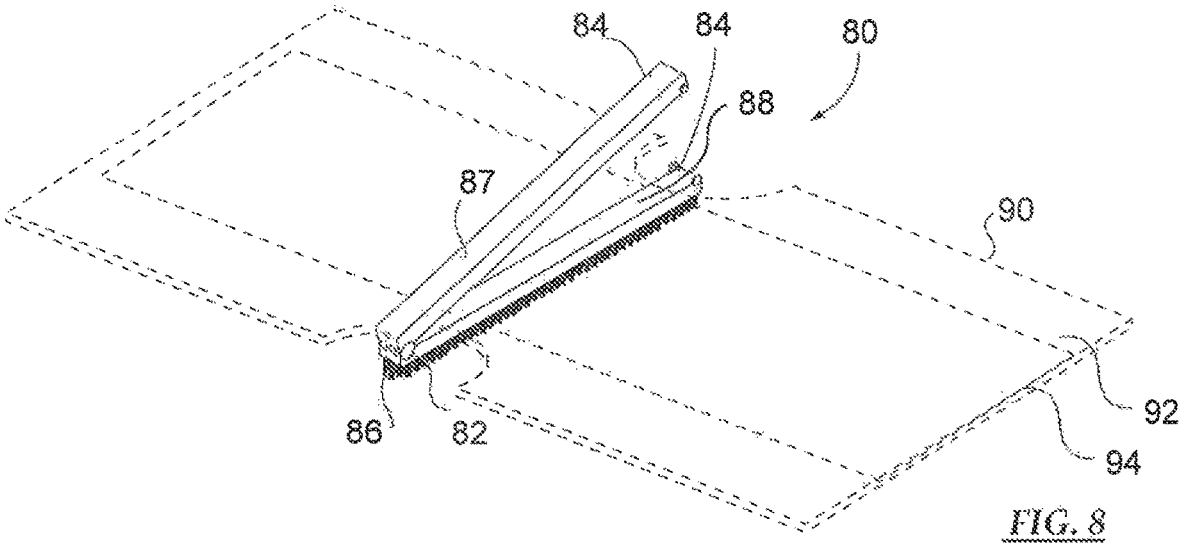
FIG. 8 is a perspective view of another alternative embodiment of the present invention showing a removable brush that can be secured to a cleaning pad.

Now referring to FIG. 8, a perspective view of another alternative embodiment, is shown and generally designated 80. This figure depicts an embodiment of the tile and grout cleaning brush 80 that can be clamped onto a tile cleaning pad 90.

Figure 9:
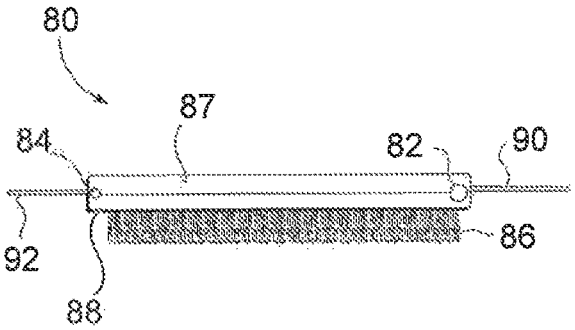
FIG. 9 is a side view of an alternative embodiment of the present invention shown in FIG. 8 showing the brush attached to a cleaning pad, with the rectangular top piece in a closed configuration.
Figure 10:
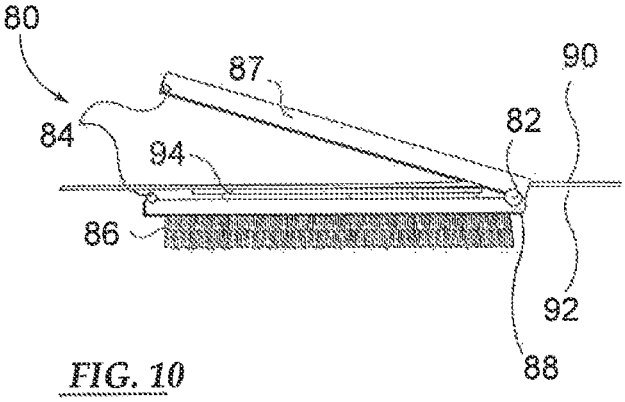
FIG. 10 is a side view of the alternative embodiment of the present invention depicted in FIG. 8 showing the relative placement of the grout cleaning brush before it is secured to the cleaning pad, with the rectangular top piece in an open configuration.

FIGS. 9 and 10 depict a side view of the embodiment of the present invention described in FIG. 8. This figure again shows a removable brush 80 that can be clamped and latched onto a cleaning pad 90. FIG. 9 depicts the embodiment in the closed position. FIG. 10 depicts the embodiment in the open position, allowing insertion or removal of a cleaning pad 90.

This embodiment consists of a rectangular base piece 88 into which brush bristles 86 are anchored and extending perpendicularly therefrom. A rectangular top piece 87 of dimensions similar to the base piece 88 is connected to the base piece 88 by way of a hinge 82. Each corresponding part of the hinge 82 is located at the end portion of the top piece 87 and end piece 88. Located at the end portions opposite the hinge 82 is a latch 84. It is to be appreciated by those skilled in the art that different types of hinge and latch designs may be used and this description is not intended to limit the designs that can be used. FIG. 9 depicts removable brush 80 with the rectangular top piece 87 closed at the hinge 82 with latch 84. FIG. 10 depicts removable brush 80 in the open configuration, with rectangular top piece 87 open at hinge 82 allowing user insertion of a cleaning pad 90.

FIG. 10 is a side view of the alternative embodiment described in FIG. 8. This figure shows the removable brush 80 positioned across a cleaning pad 90 before the top portion 87 and base portion 88 are closed and latched. It is to be noted that the removable brush 80 will completely span the cleaning surface, with latch 84 of the cleaning pad 90 when properly mounted.

Figure 11:
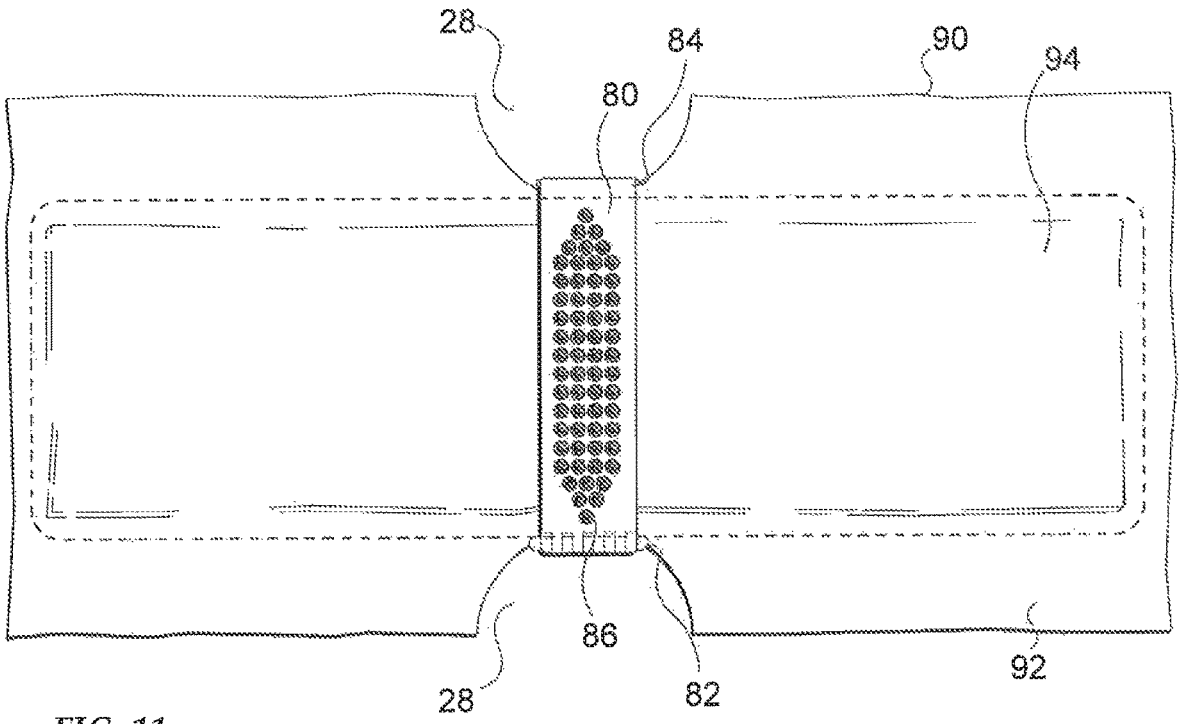
FIG. 11 is a bottom view of the alternative embodiment shown in FIGS. 8-10 when secured to a cleaning pad.

FIG. 11 is a bottom view of the removable brush 80 when mounted onto a cleaning pad 90. Backing sheet 92 has two semi-circular cut-outs 28 located at the transverse centerline of the cleaning pad 90 which allow the removable brush 80 to be mounted while leaving a sufficient amount of the backing sheet 92 to allow proper mounting to a floor cleaning system 12 (shown in FIG. 12) and sufficient amount of cleaning surface 94 to contact the floor when in use. It is to be appreciated by those skilled in the art that the exemplary layout of the brush bristles 86 is not limiting and other layouts are fully contemplated while not deviating from the intended function of the invention.

Figure 12:
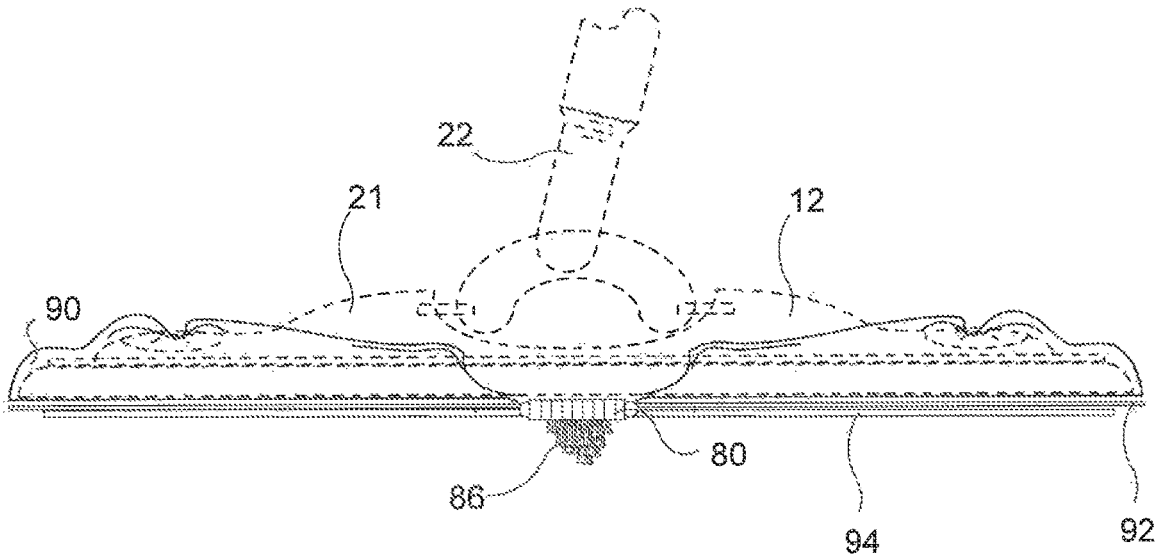
FIG. 12 is a side view of the alternative embodiment of the present invention when applied to a cleaning system.

FIG. 12 is a side view of a removable brush 80 mounted to a cleaning pad 90, which is in turn secured to the floor cleaning system head 21. The location of the removable brush 80 along the transverse centerline is demonstrated.

Figure 13:
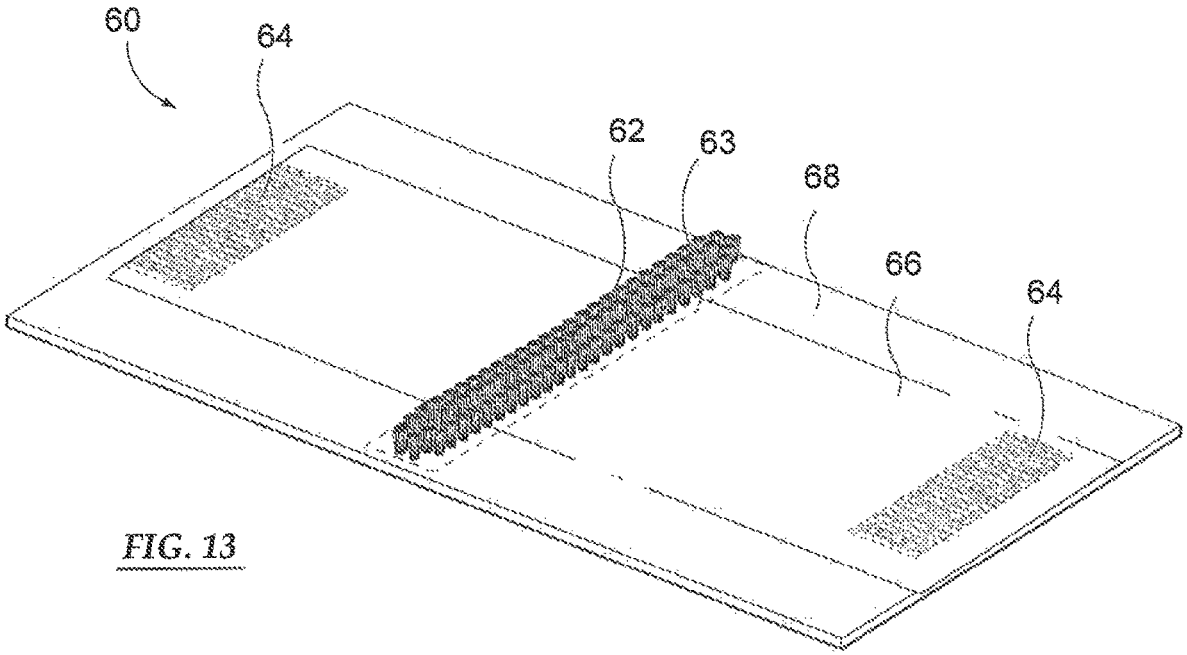
FIG. 13 is a perspective view of another alternative embodiment of the present invention showing bristles formed into a cleaning pad which utilizes hook-and-loop fastener pads, or the like (shown in phantom), to secure the pad to the cleaning system.

FIG. 13 is a perspective view of an alternative embodiment of the present invention and generally designated 60. This embodiment is also referred to as a tile and grout cleaning pad with hook-and-loop (Velcro®) fasteners. Brush bristles 62 are secured into the cleaning surface 66 by way of a brush bristle mount 63 (shown in phantom). The brush bristles 62 are mounted transversely at the midpoint of the cleaning surface 66. Velcro fasteners 64 (shown in phantom), or similar hook-and-loop system, are affixed to the backing sheet 68 and are used to attach the cleaning pad 60 to a floor cleaning system 12. The Velcro® pads 64 are located on the side of the backing sheet 68 opposite the cleaning surface 66 and brush bristles 62.

Figure 14:
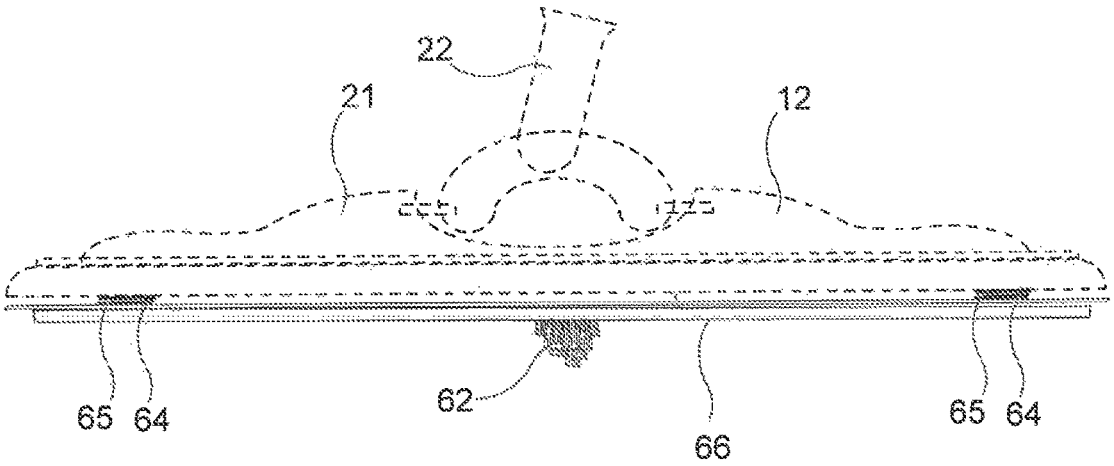
FIG. 14 is a side view of the alternative embodiment shown in FIG. 13 when secured to a cleaning system using a hook-and-loop fastening system.

FIG. 14 is a side view of a Tile and Grout Cleaning Pad with Velcro® Fasteners 60 when attached to a floor cleaning system 12. The floor cleaning system head 21 has Velcro® fastening areas 65 that correspond to the locations of the hook-and-loop fasteners, such as Velcro® fasteners, 64 on the cleaning pad 60. To mount the cleaning pad 60 onto the floor cleaning system 12, the fasteners 64 are lined up with the fastening areas 65 then moderate pressure is applied to cause the cleaning pad 60 to stay securely mounted to the floor cleaning system head 21.

Figure 15:
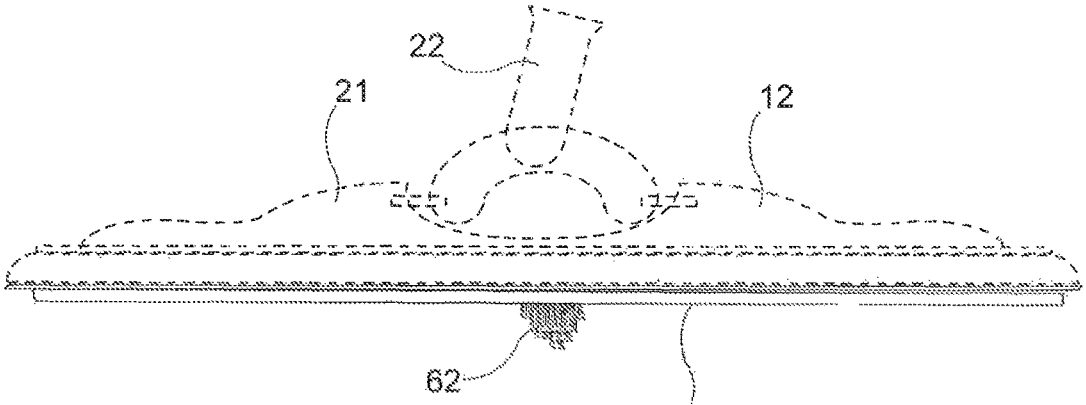
FIG. 15 is a side view of the alternative embodiment shown in FIG. 13 when secured to a commercial, off-the-shelf floor cleaning system, using a different attachment system, such as adhesive, wrap-around attachment, or another attachment system that allows the present invention to be secured to a commercial floor cleaning system.

FIG. 15 is a further side view of the attachment of tile and grout cleaning pad 60 attached to a commercial, off-the-shelf floor cleaning system. Several difference attachment systems are currently available, using a hook-and-loop type system such as Velcro®, or wrap-around attachment systems where cleaning pad 60 is larger than the base of the system head 21 and the edges of the cleaning pad 60 wrap around the edges of the system head 21 and attach to the top of the system head 21, such as the Swiffer Sweeper®. Tile and Grout Cleaning Pad 60, with bristles 62 and cleaning surface 66, may be attached by way of adhesive, wrap-around attachment, or hook-and-loop systems. The hook-and-loop system may be formed with patches of the hook-and-loop materials, as the Velcro® in FIG. 14, or where the entire base of system head 21 is covered with one part of the hook-and-loop system and the cleaning pad 60 is formed with the opposing part of the hook-and-loop system to accommodate floor cleaning systems currently in the market.

Figure 16:
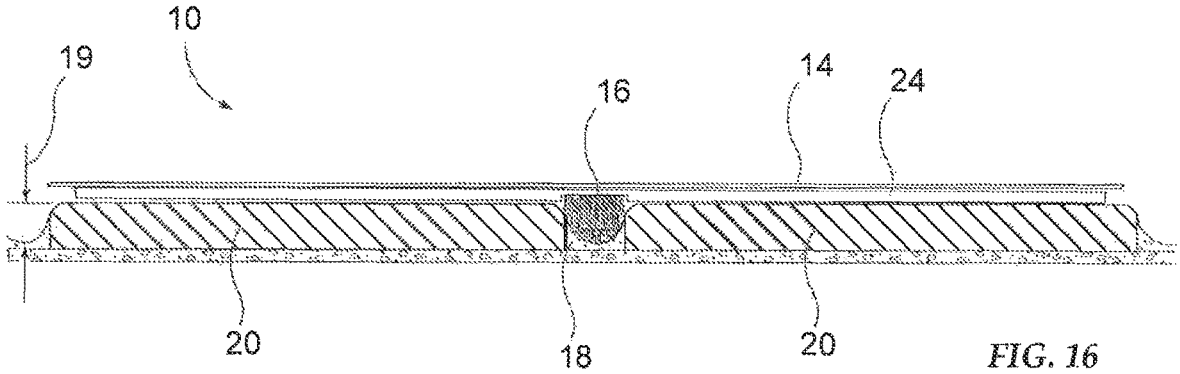
FIG. 16 is a cross sectional view of the preferred embodiment of the present invention showing the cleaning surface and bristles working simultaneously to clean both the tile surface and the grout between the tiles.

FIG. 16 is a cross sectional view of the preferred embodiment of the Tile and Grout Cleaning Pad of the present invention. Two sections of tile 20 which are separated by a section of grout 18 are shown. Brush bristles 16 are in contact with grout 18 while cleaning surface 24 is in simultaneous contact with the tile 20. This combination allows for the grout 18 and tile 20 to be cleaned at the same time.

In some implementations of grout 18 and tile 20, the surface of the grout 18 is further below the surface of the tile 20 as compared to normal implementations. This may cause the brush bristles 16 of the preferred embodiment of the cleaning pad 10 to not adequately reach and clean the grout 20. To address this issue, a cleaning pad with extended brush bristles can be used.

Figure 17:
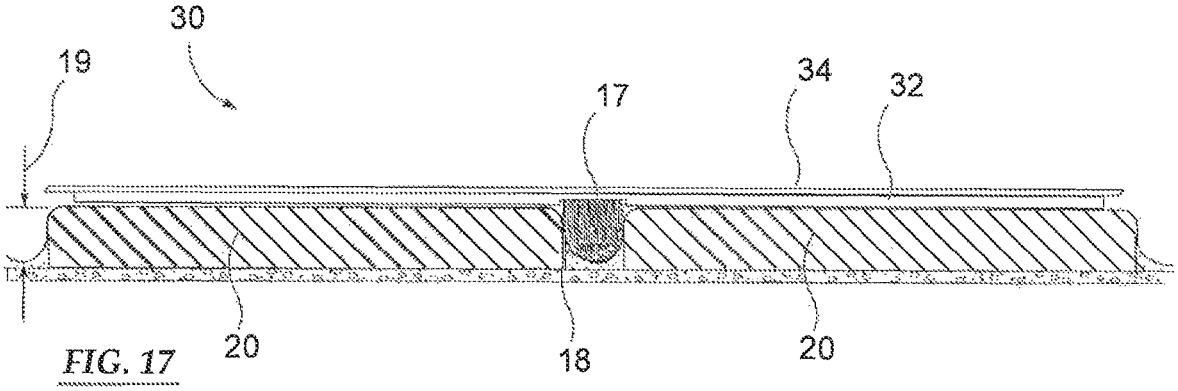
FIG. 17 is a cross sectional view of an alternative embodiment of the present invention showing bristles of an extended length for use where the grout surface is located at a greater depth below the surface of the tile, and demonstrates the cleaning surface and bristles working simultaneously to clean both the tile surface and the grout between the tiles.

FIG. 17 is an alternative embodiment of the Tile and Grout Cleaning Pad of the present invention demonstrating a cleaning pad with extended brush bristles and is generally designated 30. Two sections of tile 20 which are separated by grout 18 are shown. Extended brush bristles 17 are in contact with grout 18 while cleaning surface 32 is in simultaneous contact with the tile 20. This will allow for the grout 18 and tile 20 to be cleaned at the same time.

Figure 18:
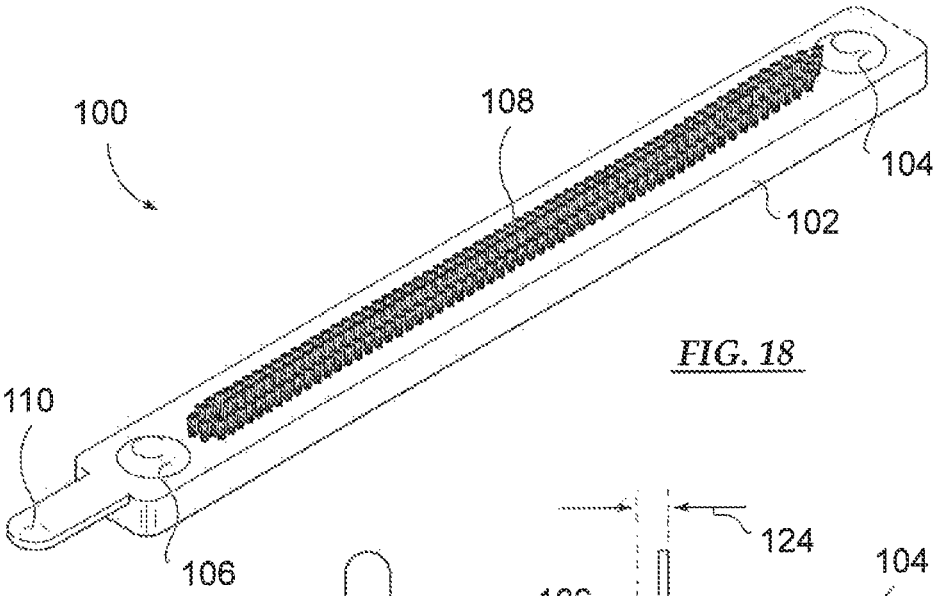
FIG. 18 is a perspective view of another alternative embodiment of the grout cleaning brush of the present invention showing a body that is formed with an array of bristles extending away from the body, and having a fastener at each end of the body that can be pushed through a floor cleaning pad to fasten the body to a cleaning pad such that the bristles extend away from the cleaning pad.

Referring now to FIG. 18, a perspective view of another alternative embodiment of the grout cleaning brush of the present invention is shown and generally designated 100. Grout cleaning brush 100 includes a body 102 that, in a preferred embodiment, is substantially rigid, and is equipped with a fasteners 104 and 106 at each end of the body 102. Fasteners 104 and 106 can be pushed through a floor-cleaning pad (not shown this figure) to securely fasten the body 102 to a cleaning pad. An array of bristles 108 extends away from the body 102 such that the bristles also extend away from a cleaning pad to contact the grout within a tile floor grout joint.

An alignment tab 110 is formed on an end of the body 102 to provide the user the ability to know where the cleaning pad is positioned. More specifically, when the grout cleaning brush 100 of the present invention is used in conjunction with a cleaning pad, the brush 100 will be substantially underneath the cleaning pad, and out of view. By aligning the alignment tab 110 with a grout joint, the user can be certain that the scrub brush 100 is positioned properly in line with the grout joint.

Figure 19:
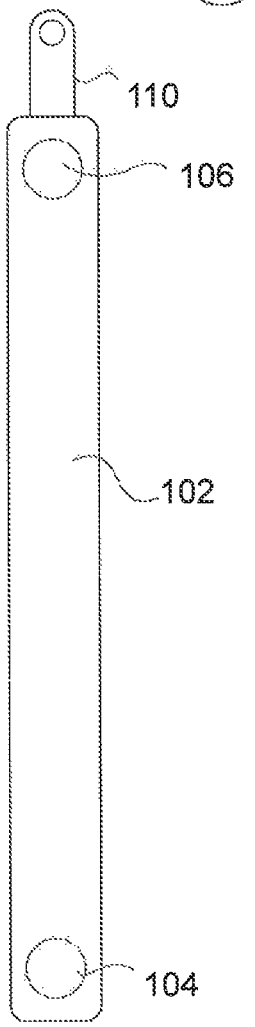
FIG. 19 is a plan view of the back of the alternative embodiment of the grout cleaning brush of FIG. 18, showing an alignment tab extending from the body, and showing the fasteners used to secure the cleaning brush to a typical floor cleaning pad.

Referring to FIG. 19, a plan view of the back of the alternative embodiment of the grout cleaning brush 100 of FIG. 18 shows the alignment tab 110 extending from the body 102. Also, the fasteners 104 and 106 are shown to be positioned adjacent the ends of the body 102, and sized to secure the cleaning brush 100 to a typical floor cleaning pad.

Figure 20:
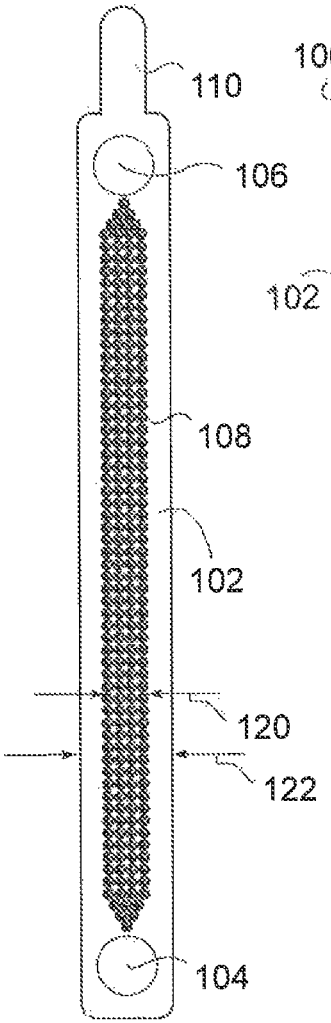
FIG. 20 is a plan view of the front of the alternative embodiment of the grout cleaning brush of FIG. 18, showing a longitudinal array of bristles extending from the body and having a pair of fasteners used to secure the cleaning brush to a typical floor cleaning pad.

FIG. 20 is a plan view of the front of the alternative embodiment of the grout cleaning brush 100 of FIG. 18 and shows a longitudinal array of bristles 108 extending from the body 102. From this view, the width of the bristles 120 is clearly shown to be less than the width 122 of body 102. From this view, it can be appreciated that the width of body 102 can be enlarged to accommodate various bristle widths 120. In a preferred embodiment, bristle width 120 may be 0.25 inches to correspond with a typical quarter inch grout line. Widths 120 may be larger or smaller to match the corresponding grout lines being cleaned. Also from FIG. 20, the placement of the fasteners 104 and 106 is shown to be positioned near the ends of body 102 and just outside the bristles 108 for easy attachment to a typical floor-cleaning pad.

The thickness 124 of body 102 is minimal in order to allow the cleaning pad (not shown this Figure) to clean the tile adjacent the brush 108. In a preferred embodiment, thickness 124 is no greater than 0.125 inches, but other thicknesses may be contemplated.

Figure 21:
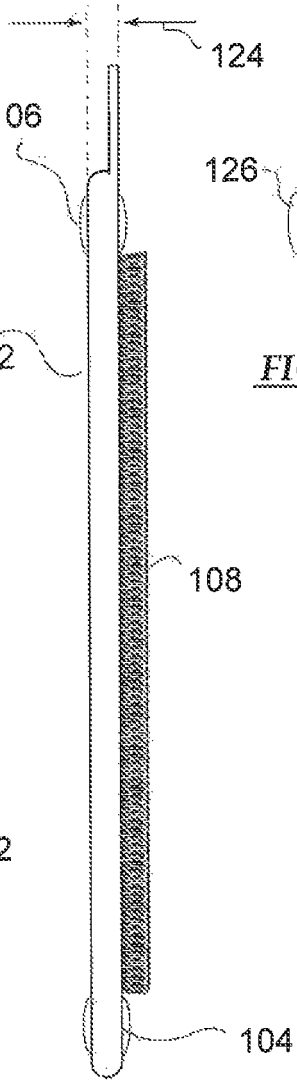
FIG. 21 is a side view of the alternative embodiment of the grout cleaning brush of FIG. 18, showing the bristles extending from the body sufficiently for positioning into the grout channels between tiles on a tile floor for cleaning, and the fasteners used to secure the grout cleaning brush to a typical floor cleaning pad.

Referring now to FIG. 21, a side view of the alternative embodiment of the grout cleaning brush 100 of FIG. 18 is shown and from this view it is to be appreciated that the length of bristles 108 may vary depending on the depth of the grout line being cleaned. Indeed, for shallow grout lines, the bristles 108 may be relatively short (less than 0.1 inches) and for deep grout lines, the bristles 108 may be longer (in excess of 0.3 inches).

Figure 22:
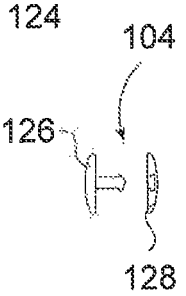
FIG. 22 is an exploded view of the fastener of the alternative embodiment of the grout cleaning brush of FIG. 18 showing a mounting pin that is insertable through the body of the scrub brush, through a typical floor cleaning pad, to be captured securely by a pin retainer that secures the mounting pin through the body and cleaning pad for use.

FIG. 22 is an exploded view of the fastener 104 and 106 of the alternative embodiment of the grout cleaning brush 100 of FIG. 18. From this view, fastener 106 includes a mounting pin 126 that is insertable through the body of the scrub brush, through a typical floor-cleaning pad, to be captured securely by a pin retainer 128 that secures the mounting pin through the body and cleaning pad for use. Mounting pin 126, in a preferred embodiment, includes a point that passes through a cleaning pad. The tip of this point is tapered to facilitate pushing of the point through the cleaning pad with minimal effort, and not requiring a pre-formed hole in the pad.

Figure 23:
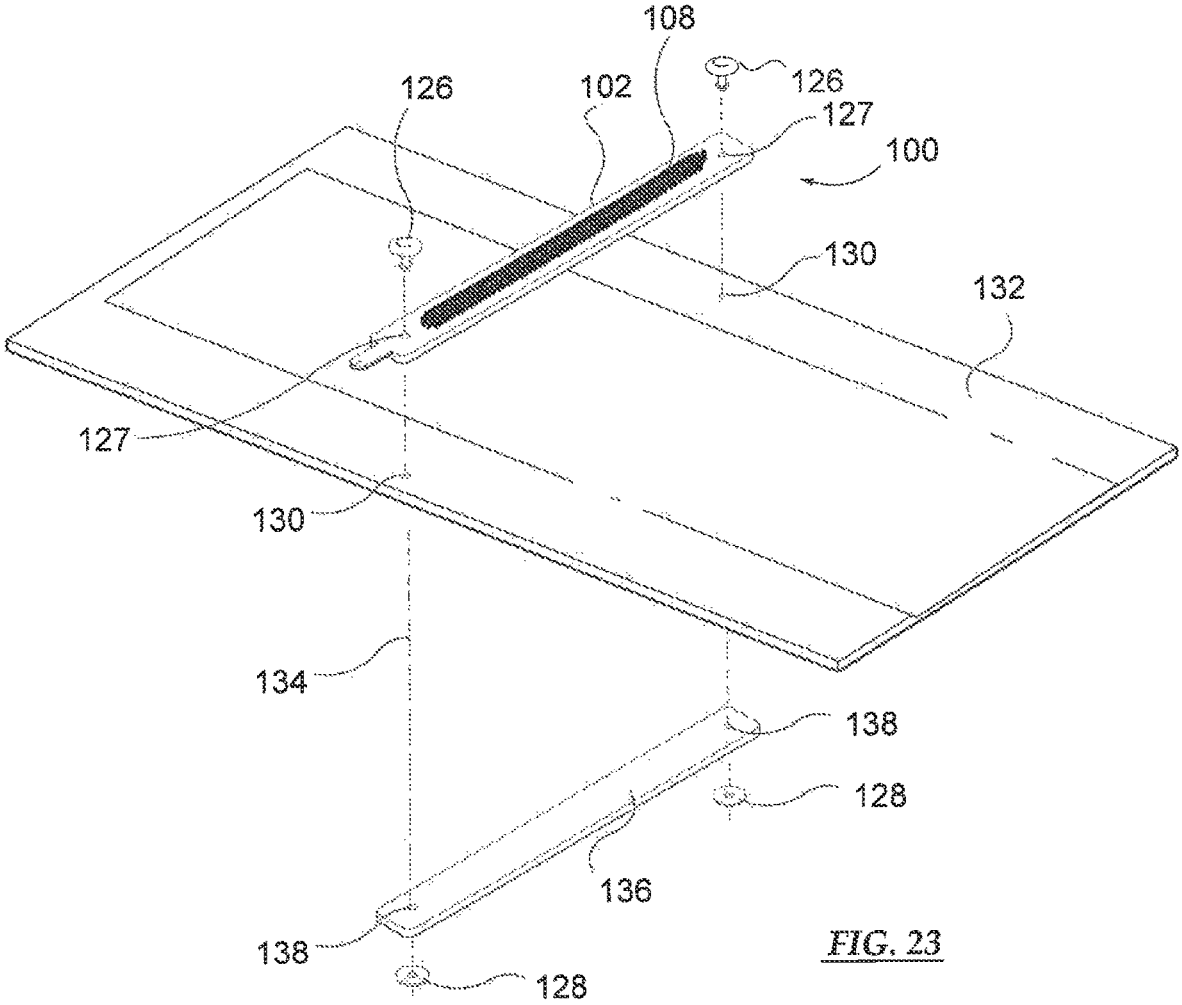
FIG. 23 is an exploded view of the alternative embodiment of the grout cleaning brush of FIG. 18 as installed on a typical cleaning pad, including the body aligned in the center of the cleaning pad with the bristles facing away from the pad, and the insert pins insertable through the body of the scrub brush, through a hole made in the cleaning pad, through a backing plate positioned adjacent the body and on an opposite side of the cleaning pad, to be secured with a pair of pin retainers that capture the retaining pin in place securing the scrub brush to the cleaning pad for use.

Referring to FIG. 23, an exploded view of the alternative embodiment of the grout cleaning brush 100 of FIG. 18 is shown as installed on a typical cleaning pad 132. Specifically, body 102 is aligned in the center of the cleaning pad 132 with the bristles 108 facing away from the cleaning surface of the cleaning pad 132. Insert pins 126 are inserted through pre-formed holes 127 in the body 102 of the scrub brush 100, through a pre-formed hole 130 made in the cleaning pad 132, and through pre-formed holes 138 formed in a backing plate 136 positioned adjacent the body 102 and on an opposite side of the cleaning pad 132.

Backing plate 136 is included in a preferred embodiment. However, it is to be appreciated that body 102 may be secured to cleaning pad 132 with the use of fasteners 104 and 106 without the use of a backing plate 136. In such an application, pin retainers 128 capture inert pin 126 to retain body 102 firmly against cleaning pad 132.

From FIG. 23 the benefit of alignment tab 110 is clear. Once grout cleaning brush 100 is firmly attached to cleaning pad 132, the majority of the grout cleaning brush 100 is beneath the cleaning pad and not visible. As a result, when a user is attempting to clean a grout line a tile floor, it would be difficult to ascertain whether the bristles 108 are aligned with the grout lines. The alignment tab 110, however, extends outside the coverage of cleaning pad 132. Alignment tab 110 provides the user a visible alignment device so that the bristles 108 can be precisely placed in the grout line for use.

Figure 24:
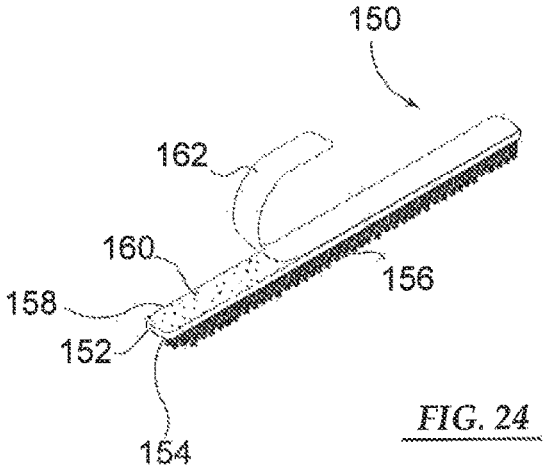
FIG. 24 is a perspective view of yet another alternative embodiment of the grout cleaning brush of the present invention, and includes a body having a front surface that is equipped with a longitudinal array of scrub brush bristles, and a back surface that is coated with an adhesive and covered with a removable covering such that the removable covering may be removed to expose the adhesive which will retain the scrub brush in place on a typical cleaning pad.

Referring now to FIG. 24, a perspective view of yet another alternative embodiment of the grout cleaning brush of the present invention is shown and generally designated 150. Grout cleaning brush 150 includes a body 152 having a front surface 154 that is equipped with a longitudinal array of scrub brush bristles 156, and a back surface 158 that is coated with an adhesive 160 and covered with a removable covering 162. The removable covering 162 may be removed to expose the adhesive 160, which once positioned, will retain the scrub brush 150 in place on a typical floor-cleaning pad 132.

Figure 25:
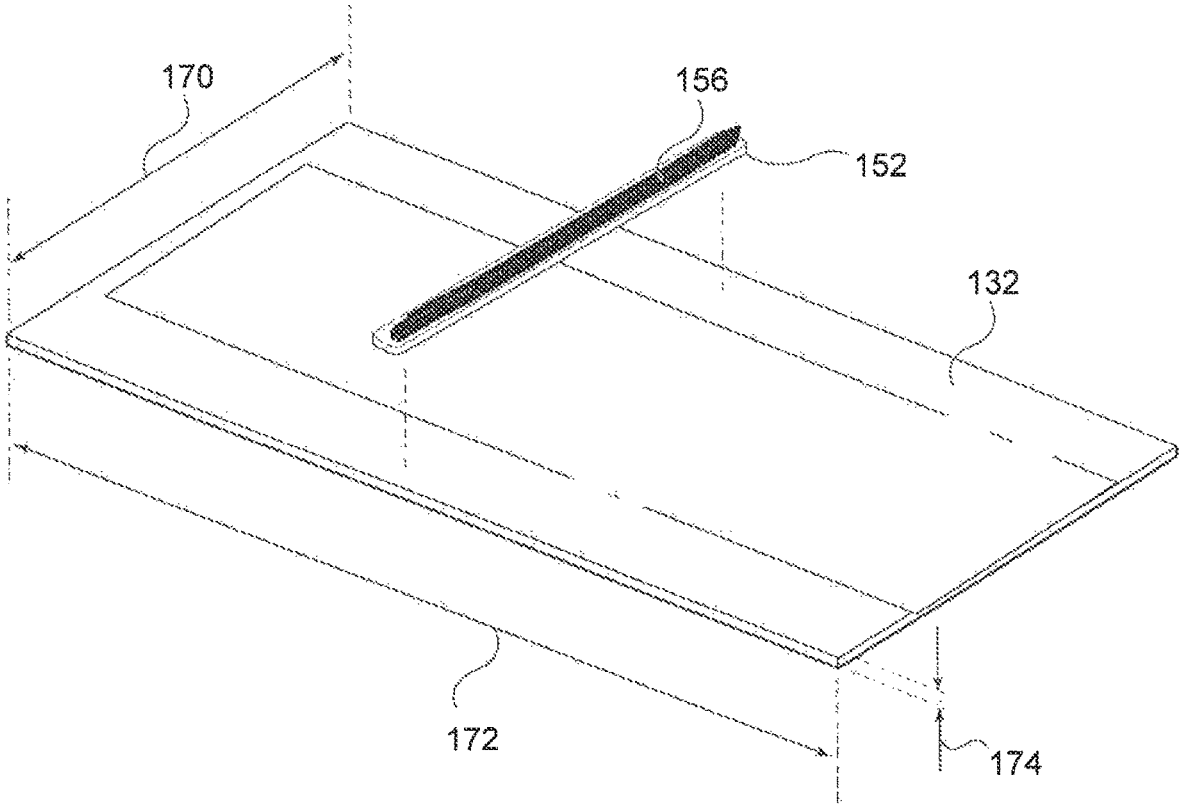
FIG. 25 is an exploded view of the alternative embodiment of the grout cleaning brush of FIG. 24 showing the body positioned above the middle of a typical cleaning pad for attachment by pressing the adhesive against the surface of the cleaning pad.

FIG. 25 is an exploded view of the alternative embodiment of the grout cleaning brush 150 of FIG. 24, and shows the body 152 positioned above the middle of a typical cleaning pad 132 for attachment. In order to attach grout cleaning brush 150 to a cleaning pad, the adhesive 160 is exposed by removing the covering 162, and then pressing the adhesive side of body 152 against the cleaning pad 132.

A typical floor-cleaning pad 132 is shown in FIG. 25, and has a width 170, length 172 and thickness 174 of approximately 5.5 inches, 12 inches, and 0.125 inches, respectively. However, it is to be appreciated that the specific dimension of the cleaning pads depicted herein are not critical to the practice of the present invention. Indeed, the present invention may be used in conjunction with a cleaning pad 132 having virtually any dimension.

FIG. 25 also depicts a cleaning pad 132 equipped with a single grout cleaning brush 150. It is to be appreciated that multiple grout cleaning brushes 150 may be incorporated with a single cleaning pad 132. One such application would include placement of two cleaning brushes 150 in parallel on the same cleaning pad 132, and spaced apart a distance corresponding to the dimension of the tile to be cleaned. For instance, by separating the two grout cleaning brushes 150 by 8 inches, the brushes 150 would be perfectly positioned for cleaning a tile floor having grout lines separated by the dimension of the tile, namely 8 inches.

While there have been shown what are presently considered to be preferred embodiments of the present invention, it will be apparent to those skilled in the art that various combinations of preferred embodiments, changes and modifications can be made herein without departing from the scope and spirit of the invention.

I claim:

1. A tile and grout cleaning pad comprising:

a pliable disposable cleaning pad having a cleaning surface, a length, and a width shorter than said length, said cleaning surface configured to contact and clean a tiled surface located at a first depth;

a grout cleaning brush extending from said pliable disposable cleaning pad and comprising a substantially continuous region of bristles having a width and a length greater than said width, said brush centered along the length of said cleaning pad with the length of said brush along the width of said cleaning pad wherein said bristles of said grout cleaning brush extend outward from-the cleaning surface to contact and clean a grouted surface located at a second depth greater than said first depth of said first surface; and wherein said cleaning surface contacts said first surface and said grout cleaning brush contacts said second surface simultaneously allowing the simultaneous cleaning of said tiled surface at the first depth and said grouted surface at the second depth greater than said first depth.

2. The tile and grout cleaning pad of claim 1, wherein the grout cleaning brush is formed into the cleaning pad.

3. The tile and grout cleaning pad of claim 1, wherein the grout cleaning brush is removably attached to the cleaning surface of the cleaning pad by a fastening means.

4. The tile and grout cleaning pad of claim 3, wherein the fastening means is a clamp comprising:

a top piece hingeably affixed to the grout cleaning brush opposite the bristles, the top piece having a latch means securing an end of the top piece opposite the hinge to the grout cleaning brush.

5. The tile and grout cleaning pad of claim 3, wherein the fastening means is a mounting pin and pin retainer system comprising:

a plurality of mounting pins, insertable through the grout cleaning brush; and a plurality of pin retainers formed to secure mounting pins in place.

6. The tile and grout cleaning pad of claim 3, wherein the fastening means is comprised of an adhesive.

7. The tile and grout cleaning pad of claim 1, wherein the plurality of bristles extend outward from the cleaning pad for an appropriate distance allowing simultaneous cleaning of the grout and the tile.

8. The tile and grout cleaning pad of claim 1, wherein the grout cleaning brush further comprises an alignment tab, extending from an end of the grout cleaning brush, said grout cleaning brush mounted transversely at a midpoint of said disposable cleaning pad wherein said grout cleaning brush is located underneath said cleaning surface and said alignment tab extends past said cleaning surface to provide visual indication of said grout cleaning brush when in use.

9. The tile and grout cleaning pad of claim 1, wherein said pliable disposable cleaning pad further comprises a backing sheet formed with edges, said edges of said backing sheet can be wrapped around and secured to the head of a floor cleaning system.

10. The tile and grout cleaning pad of claim 1 further comprising a base piece, wherein said base piece is disposed under said cleaning surface sheet wherein said bristles protrude through said cleaning surface sheet.

11. The tile and grout cleaning pad of claim 10, wherein said grout cleaning brush is attached transversely at a midpoint of said backing sheet.

12. The tile and grout cleaning pad of claim 11, wherein the grout cleaning brush is integrally formed into the cleaning surface sheet.

13. The tile and grout cleaning pad of claim 12, wherein the grout cleaning brush is attached to said backing piece by an adhesive.

* * * * *